United States Patent [19]

Albrecht et al.

[11] Patent Number: 4,558,544

[45] Date of Patent: Dec. 17, 1985

[54] ADJUSTABLE PEDESTAL FOR ELEVATED FLOORS

[75] Inventors: Raymond E. Albrecht; Robert G. Lindner, both of Sewickley, Pa.

[73] Assignee: H. H. Robertson Company, Pittsburgh, Pa.

[21] Appl. No.: 676,449

[22] Filed: Nov. 29, 1984

Related U.S. Application Data

[63] Continuation of Ser. No. 480,577, Mar. 30, 1983, abandoned.

[51] Int. Cl.[4] ..... B66F 1/00

[52] U.S. Cl. ..... 52/126.6; 52/126.1; 52/263

[58] Field of Search ..... 52/122.1, 126.3, 126.4, 52/126.5, 126.6, 126.7, 222, 241, 242, 243.1, 262, 263, 290, 678; 248/354.3, 354.4, 357

[56] References Cited

U.S. PATENT DOCUMENTS

| | | | |
|---|---|---|---|
| 3,025,934 | 3/1962 | Spiselman et al. | 52/126.6 |
| 3,084,911 | 4/1963 | Spiselman | 254/98 |
| 3,100,624 | 8/1963 | Spiselman | 254/101 |
| 3,253,080 | 5/1966 | Spiselman et al. | 52/241 |
| 3,279,134 | 10/1966 | Donovan | 52/126.6 |
| 3,318,057 | 5/1967 | Northworth | 52/126.6 |
| 3,398,933 | 8/1968 | Haroldson | 254/98 |
| 3,470,663 | 10/1969 | Tate | 52/126.6 |
| 3,511,001 | 5/1970 | Morgan, Jr. | 52/393 |
| 3,681,882 | 8/1972 | Bettinger | 52/126.6 |
| 3,899,857 | 8/1975 | Mochizuki | 52/126.6 |
| 3,924,370 | 12/1975 | Cauceglia et al. | 52/126.6 |
| 4,438,610 | 3/1984 | Fifer | 52/126.6 |

FOREIGN PATENT DOCUMENTS

| | | | |
|---|---|---|---|
| 2137870 | 2/1973 | Fed. Rep. of Germany | 52/126.7 |

*Primary Examiner*—John E. Murtagh
*Assistant Examiner*—Andrew Joseph Rudy
*Attorney, Agent, or Firm*—George E. Manias

[57] ABSTRACT

An adjustable pedestal adapted to support individually removable panel members in accurate, edge-aligned relation and in a common horizontal, that is level plane. The pedestal includes a head assembly supported on an upper end of a support. The head assembly includes a head member having a generally flat upper surface which is adjustable vertically, rotationally and laterally of the support rod. Abutment means adjustable along the support rod, is engaged by the head member and establishes a position of the head member wherein the upper surface resides in the horizontal plane. Clamping means clamps the head member to the support rod. Radially extending lugs extend above the upper surface of the head member. The arrangement is such that an adjacent pair of lugs of one pedestal cooperates with adjacent pairs of lugs from adjacent pedestals to define a panel supporting surface which is horizontal and which coincides with said horizontal plane.

20 Claims, 15 Drawing Figures

ADJUSTABLE PEDESTAL FOR ELEVATED FLOORS

CROSS-REFERENCES TO RELATED APPLICATIONS

This is a continuation of application Ser. No. 480,577, now abandoned, filed Mar. 30, 1983.

BACKGROUND OF THE INVENTION

1. Field of the Invention

This invention relates to elevated floors, and more particularly to an improved adjustable pedestal for use in supporting panel members forming the elevated floor.

2. Description of the Prior Art

Elevated floors, also known as pedestal floors, provide a large unobstructed chamber through which the electrical wiring of various electrical services is distributed, and within which feed conduits for conditioned air extend. The chamber may also serve as a return air plenum. Elevated flooring incorporates plural pedestals which are uniformly distributed over a subfloor, such as a concrete floor of multi-story buildings. The pedestals cooperate in supporting the floor panels such that they are individually removable to gain access to the chamber there beneath. The panel members, as a group, provide a relatively, flat, high-strength floor which sustains walking and standing of personnel, supports apparatus and furnishings of the room, and supports moving loads as the apparatus and furnishings are introduced into the room or are altered and replaced.

It is highly desirable that the pedestals be capable of supporting the panel members in a level condition. However, since it is virtually impossible to construct a subfloor having a dead flat and level upper surface, vertically adjustable pedestals have been provided which are capable of compensating for the high and low areas normally exhibited by the subfloor. Typical examples of such vertically adjustable pedestals will be found in U.S. Pat. Nos. 3,025,934 (Spiselman et al), 3,084,911 (Spiselman), 3,279,134 (Donovan), 3,398,933 (Haroldson), and 3,681,882 (Bettinger). In addition to vertical adjustability, other pedestals have incorporated leveling means by which the head member or the support rod may be tilted to position the panel supporting surfaces of the pedestals in a common horizontal, that is level plane. The leveling means is intended to compensate for any surface irregularities of the subfloor. Typical examples of such pedestals will be found in U.S. Pat. Nos. 3,100,624 (Spiselman), 3,318,057 (Norsworthy), and 3,470,663 (Tate).

In all elevated floor structures, each panel member is intended to fit within an opening defined by the contiguous sides of adjacent panel members. To accomplish the required fit, it is necessary that each pedestal be secured to the subfloor precisely at a predetermined location. Out-of-position pedestals cannot be tolerated. Anticipating the possibility of out-of-position pedestals, the Norsworthy '057 pedestal utilizes a head member and a levelling pad presenting complementary spherical surfaces which cooperate to accommodate any divergence of the support rod from true vertical. An oversize cap member is provided presenting linear beads at its upper surface. The cap member is slideable laterally over the levelling pad to compensate for any deviations of the pedestal from its required location and to allow the linear beads thereof to be aligned with similar linear beads of adjacent pedestals. An adhesive is disclosed for securing the levelling pad to the head member and to the cap member. A slow-setting adhesive is preferred to allow sufficient time for levelling the levelling pad and for orienting the cap member prior to the development of a permanent bond. The Norsworthy '057 patent provides one arrangement capable of compensating for out-of-position pedestals. However, the arrangement has at least two distinct disadvantages both arising from the use of a slow-setting adhesive. First, the time required to complete the floor structure is extended. The panel members cannot be installed until after the adhesives have developed permanent bonds. Secondly, a misaligned and/or non-levelled support is produced if either the cap member and/or the levelling pad are inadvertently moved prior to the development of permanent adhesive bonds and such movement goes unnoticed. Since the adhesively secured head member, levelling pad and cap member constitutes an integral structure, the misaligned and/or non-levelled integral head assembly must be removed and the installation procedure repeated using newly provided head member, levelling pad and cap member.

SUMMARY OF THE INVENTION

The principal object of this invention is to provide an adjustable pedestal which overcomes the deficiencies of prior art pedestals.

Another object of this invention is to provide an adjustable pedestal which facilitates precise erection of an elevated floor structure.

Still another object of this invention is to provide an adjustable pedestal having a base member secured to a subfloor and a head member adjustably connected to the support rod and which may be precisely located and then mechanically locked into the required panel member supporting position relative to the head members of adjacent pedestals.

A further object of this invention is to provide an adjustable pedestal having a head assembly including a head member and cooperating components by which the head member can be adjusted vertically to the required height, can be rotated about and displaced laterally in all directions relative to the support rod to align directional indicators presented by the head member in the required direction, and then clamped in the required adjusted position.

In accordance with the present invention, an adjustable pedestal is provided which is adapted to support panel members of an elevated floor structure. The adjustable pedestal comprises a base member adapted to be secured to a subfloor; a substantially vertical support rod extending upwardly from the base member and having a threaded upper end; and a head assembly adjustably connected to the threaded upper end. The head assembly includes a head member having an upper surface adapted to support the panel members and which is adjustable vertically, rotationally and laterally of the upper end. Abutment means engageable by the head member, is adjustable along the threaded upper end to establish a position of the head member along the support rod wherein the upper surface of the head member resides in a horizontal plane. Clamping means is provided which clamps the head member to the upper end at the desired height above the subfloor as determined by the abutment means and at the desired orientation.

Thus, in accordance with this invention, a plurality of the pedestals may be secured to the upper surface of the subfloor in substantially vertical orientation. Each pedestal is substantially precisely located at the intersection of grid lines provided on the subfloor. To facilitate positioning of the base member, sets of mutually perpendicular indicia are provided at the periphery of the base member, each set being aligned with one of the grid lines. Thereafter, the abutment means is elevated to the desired height, that is into horizontal coplanar relationship with the other abutment means. When the head members are engaged with abutment means they are automatically positioned at the correct height and in a common horizontal plane.

Each head member is provided with sets of mutually perpendicular, upstanding lugs, each set of lugs being provided with directional indicia at upper surfaces thereof. Utilizing a sighting device, such as a laser transit or the like and the directional indicia presented by the lugs, the head members of all of the pedestals may be accurately positioned. It should be remembered that in accordance with the present invention, each head member is capable of rotation about the support rod and is capable of displacement laterally in all directions relative to the support rod. The rotational and lateral displacement capabilities of the head member assure accurate positioning of the upstanding lug of each head member in alignment with the previously provided grid lines. The displacement capability of the head member is particularly useful in accommodating any misalignments between the base member and the grid lines. Once oriented, the head member is rigidly affixed to the support rod by the clamping means. Should the head member be inadvertently knocked out of position, one need only release the clamping means, align the head member and then tighten the clamping means.

DESCRIPTION OF THE PREFERRED EMBODIMENT(S)

Figure 1:
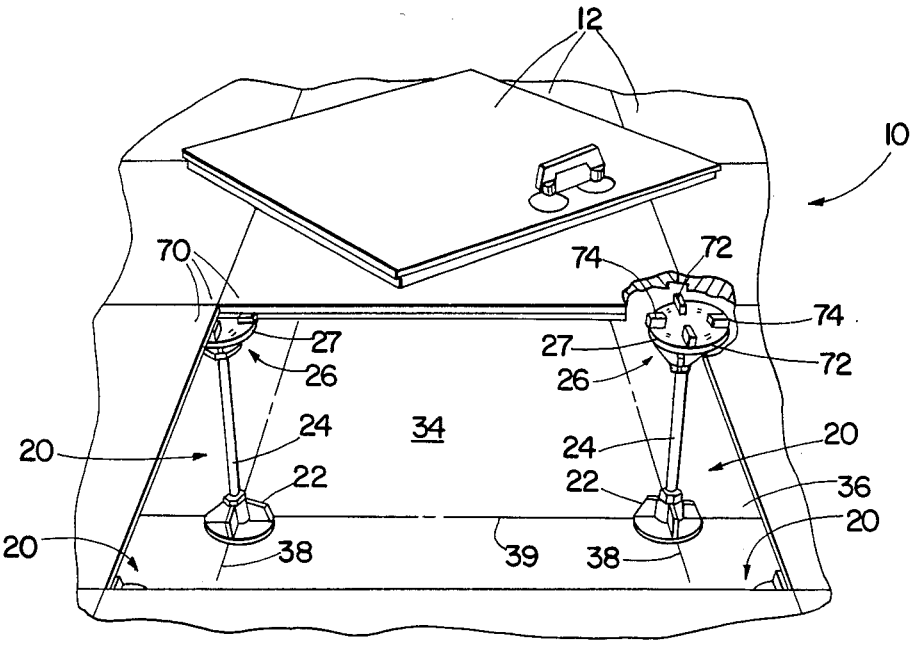
FIG. 1 is a fragmentary perspective view of an elevated floor structure with a panel member removed to expose the pedestals of this invention.

Reference is now directed to FIG. 1 wherein there is illustrated a fragmentary perspective view of an elevated floor structure identified generally by the numeral 10. The floor structure 10 comprises plural panel members 12. One of the panel members 12 is shown removed to expose pedestals 20 of this invention, which support the panel member 12 above a subfloor 36. Each of the pedestals 20 includes a base member 22 secured to the upper surface 34 of the subfloor 36. As will be described, each of the base members 22 is positioned at a location defined by mutually perpendicular grid lines 38, 39 provided on the upper surface 34.

Each pedestal 20 also includes a support rod 24 extending upwardly from the base member 22. The support rod carries a head assembly 26 including a head member 27 having sets of mutually perpendicular, radially extending, upstanding lugs 72, 74—adjacent lugs 72, 74 receiving and retaining a corner 70 of the panel members 12. Also as will be described, abutment means (not visible) is provided to establish the required height of the head member 27 above the upper surface 34. The head member 27 can, during installation, be rotated about the support rod 24 and can be displaced laterally in all directions relative to the support rod 24 to align the lugs 72, 74 with the grid lines 38, 39. The ability of the head member 27 to be displaced laterally in all directions relative to the rod 24, accommodate any misalignments between the base member 22 and the grid lines 38, 39. Clamping means (not visible) is provided for clamping the head member 27 in fixed orientation relative to the grid lines 38, 39.

Figure 2:
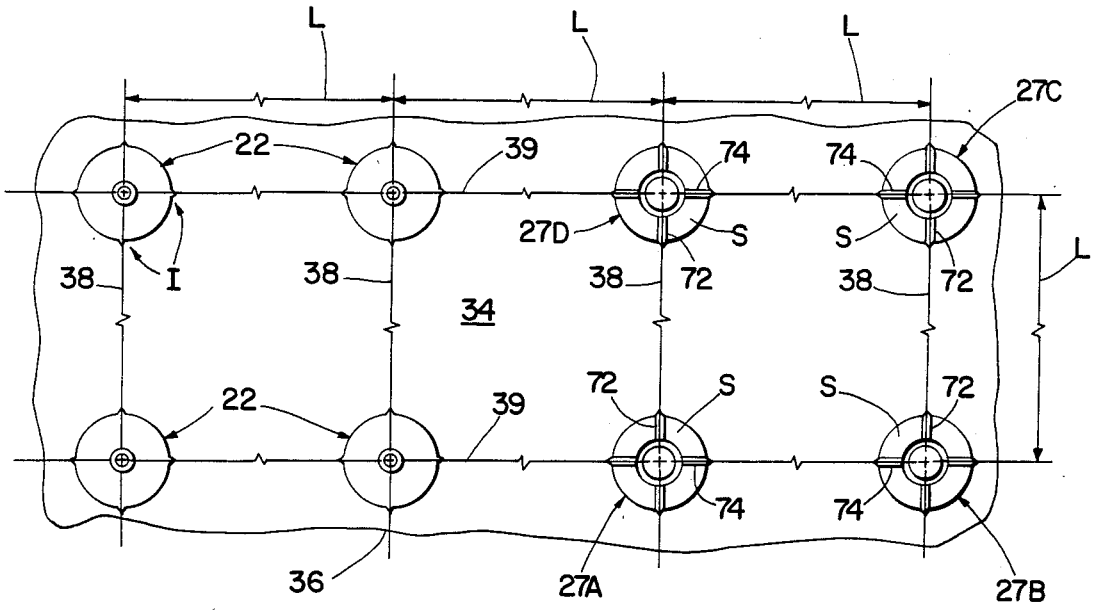
FIG. 2 is a fragmentary plan view, partly in cross-section, illustrating an array of rows and columns of base members and head members aligned with grid lines.

FIG. 2 illustrates a typical arrangement wherein the grid lines 38, 39 provided on the upper surface 34, are equidistantly spaced-apart as indicated by the dimension lines L. Base members 22 are shown having directional indicia I (to be hereinafter described and illustrated) which facilitate positioning each base member 22 at one intersection of the grid lines 38, 39. Head members 27A, 27B, 27C and 27D also are shown, aligned with grid lines 38, 39. As will become apparent, the rotational and lateral adjustments provided by the pedestal construction allows precise alignment of the lugs 72, 74 of each head member 27 with grid lines 38, 39. Such adjustments compensate for any inadvertent misalignments of the base member 22 with the grid lines 38, 39.

It will be observed that each pair of adjacent pedestals 27A, 27B and 27D, 27C have the lugs 74 thereof aligned with each other. Similarly, each pair of adjacent pedestals 27A, 27D and 27B, 27C have the lugs 72 thereof aligned with each other. The arrangement is such that each pair of adjacent lugs 72, 74 define surfaces S and such that the surfaces S cooperate to define a panel supporting surface which is horizontal.

Figure 3:
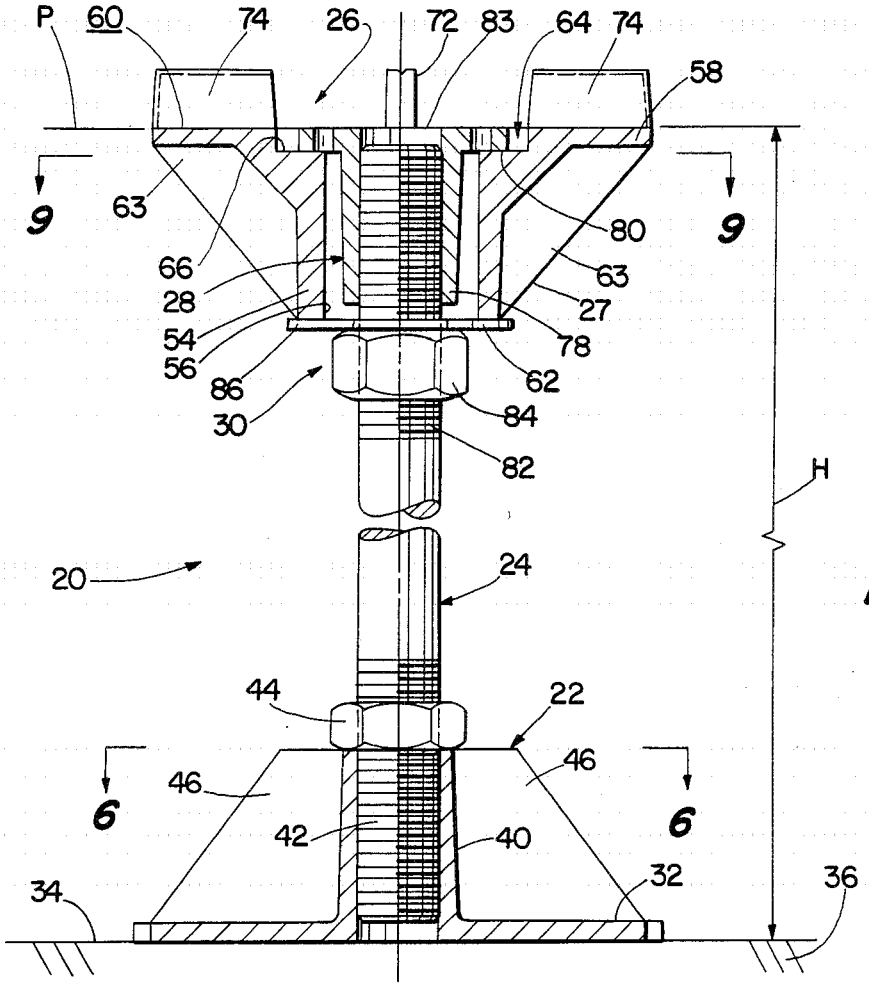
FIG. 3 is a cross-sectional view taken along the line 3—3 of FIG. 4 illustrating cooperating components of the pedestal of this invention.

Reference is now directed to FIG. 3 which illustrates the pedestal of this invention. The pedestal 20 comprises, in general, the base member 22, the support rod 24, and the head assembly 26 which includes the head member 27, abutment means 28 and clamping means 30.

Figure 6:
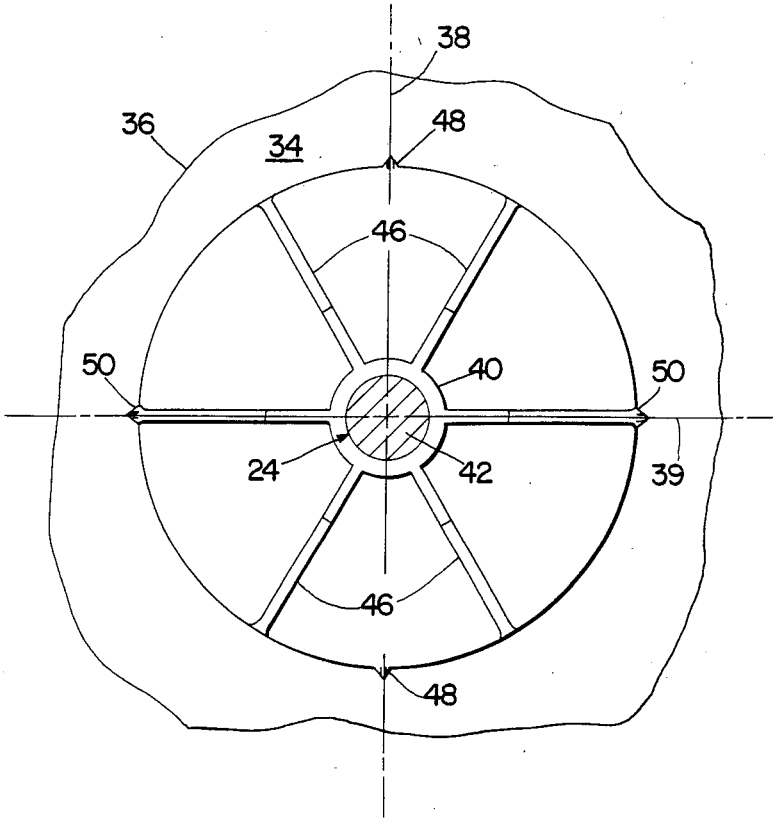
FIG. 6 is a cross-sectional view taken along the line 6—6 of FIG. 3, further illustrating a base member.

Referring to FIGS. 3 and 6, the base member 22 comprises a base plate 32 adapted to be secured by any suitable means to the upper surface 34 of a subfloor 36.

In the preferred arrangement, the base plate 32 is secured to the upper surface 34 by suitable adhesives, such as an epoxy adhesive. If needed, shims (not shown) may be inserted between the base plate 22 and the upper surface 34 to render the support rod 24 truly vertical. Alternatively, the base member 22 may be provided with three levelling screws (not shown) extending downwardly through threaded openings in the base plate 32 and adjacent to the periphery thereof. The levelling screws would be equiangularly spaced about the hub 40 and positioned at the apices of an equilateral triangle. By vertically adjusting one or more of the levelling screws, the support rod 24 would be rendered truly vertical.

An internally threaded central hub 40 extends upwardly from the base plate 32 and receives a threaded lower end 42 of the support rod 24. A jamb nut 44 (FIG. 3) secures the support rod 24 to the base member 22. Plural stiffening ribs 46 reinforce the hub 40 against lateral loads transferred from the panel members to the base member 22.

Figure 7:
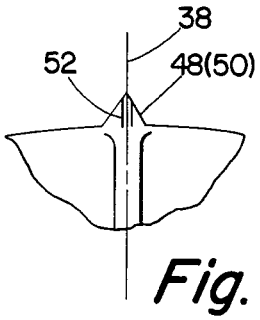
FIG. 7 is an enlarged fragmentary plan view illustrating the directional indicium provided on the periphery of the base member.
Figure 8:
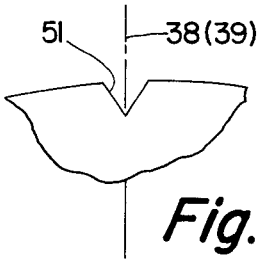
FIG. 8 is an enlarged fragmentary plan view illustrating an alternative directional indicium.

The base member 22 is adapted to be secured to the subfloor 36 at a selected location defined by the intersection of mutually perpendicular grid lines 38, 39 (FIG. 2). To this end, the base plate 32 (FIG. 6) is provided with sets of mutually perpendicular, directional indicia which are alignable with the grid lines 38, 39. In the preferred arrangement, the directional indicia take the form of first diametrically opposite pointed projections 48 for alignment with the grid lines 38(or 39) and second diametrically opposite, pointed projections 50 for alignment with the grid lines 39(or 38). As best seen in FIG. 7, each projection 48(50) is provided with a V-shaped groove 52 to assist in aligning the projection 48(50) with the grid lines 38(39). Alternatively and as shown in FIG. 8, the directional indicium may take the form of a V-shaped notch 51.

Reverting to FIG. 3, the head member 27 includes a tubular portion 54 having a central bore 56, a radially extending upper head end 58 presenting a generally flat upper surface 60 adapted to support the floor panels (not illustrated), and an annular lower head end 62. Plural stiffening ribs 63 are provided. The head member 27 also presents an annular recess 64 (FIGS. 3 and 4) in the upper surface 60 thereof, which provides an annular shoulder 66 positioned to be engaged by the abutment means 28.

Figure 5:
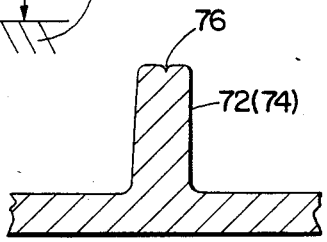
FIG. 5 is a cross-sectional view taken along the line 5—5 of FIG. 4.
Figure 4:
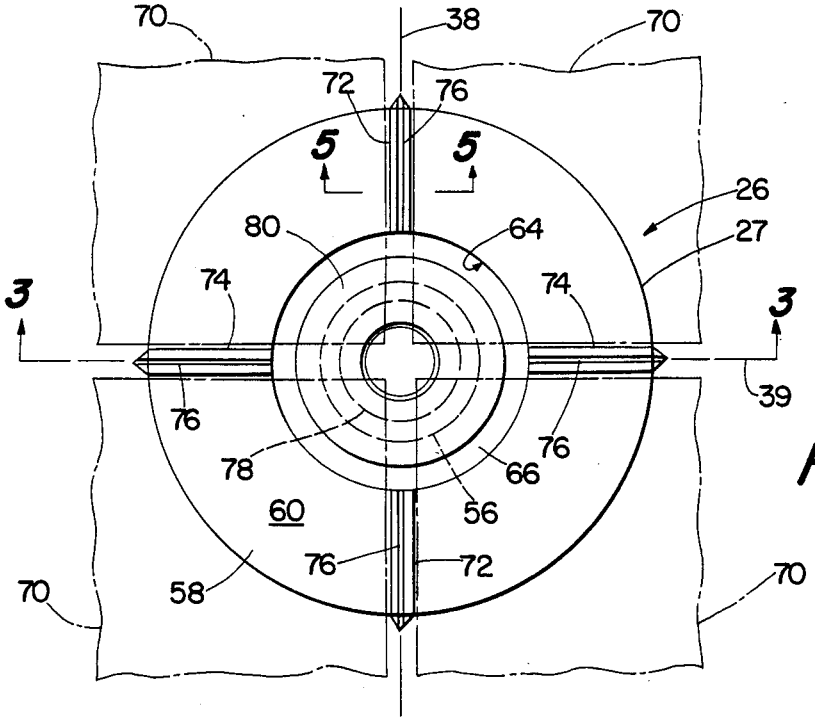
FIG. 4 is a plan view of the pedestal of FIG. 3.

The upper surface 60 of the head member 27 provides a support for the corners of four adjacent panel members schematically illustrated by the dash-dot lines 70 in FIG. 4. The first and second diametrically opposite positioning lugs 72, 74, extending upwardly (see FIG. 3) from the upper surface 60, assure proper seating and preclude lateral shifting of the panel members. The upper surface of each of the lugs 72, 74 is provided with directional indicia such as a V-shaped groove 76 (FIG. 5) which facilitates alignment of the lugs 72, 74 with the grid lines 38, 39.

Referring to FIG. 3, the abutment means 28 serves to establish the height H of the upper surface 60 of the head member 27, above the subfloor 36. The abutment means 28 comprises a tubular member 78 having a radial flange 80. The tubular member 78 is threadedly engaged with the upper end 82 of the support rod 24 and therefore is vertically adjustable. The tubular member 78 presents an upper surface 83, used as a reference surface during vertical adjustments to place the upper surface 60 of the head member 27 at the required height H. The radial flange 80 is received within the annular recess 64 and abuts the annular shoulder 66. In the preferred arrangement, the upper surface 60 and the upper surface 83 lie in a common plane represented by the dash-dot line P. Thus, when the head member 27 abuts the radial flange 80, the upper surface 60 is automatically positioned at the required height H.

The clamping means 30 serves to clamp the head member 27 to the threaded upper end 82 of the support rod 24 at the required height H and with the lugs 72, 74 aligned with the grid lines 38, 39. The clamping means 30 comprises a nut 84 threadedly engaged with the threaded upper end 82 of the support rod 24, and an annular plate 86 supported by the nut 84 and engaged with the annular end 62 of the tubular portion 54. The arrangement is such that when the nut 84 is tightened down, the head member 27 is immovably clamped between the annular plate 86 and the radial flange 80 of the tubular member 78. Thus in the illustrated arrangement, the abutment means 28 forms part of the clamping means 30.

Figure 9:
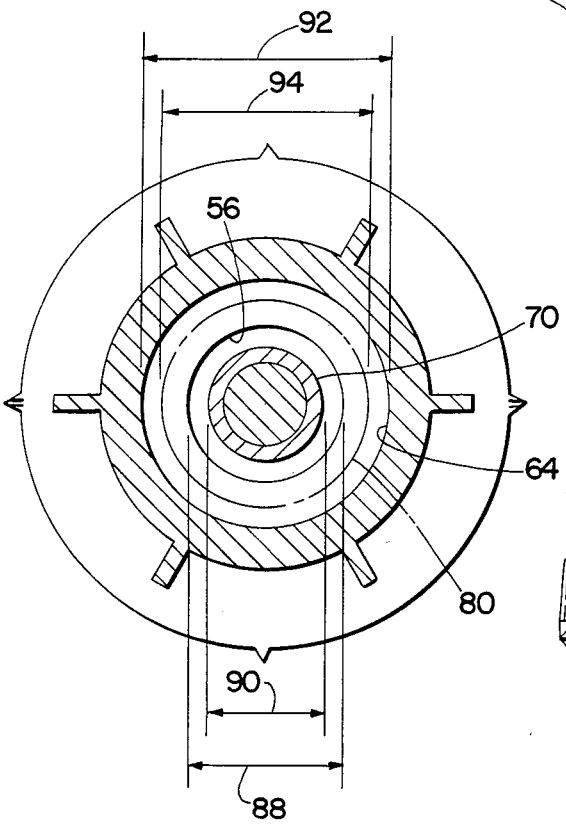
FIG. 9 is a cross-sectional view taken along the line 9—9 of FIG. 2.
Figure 10:
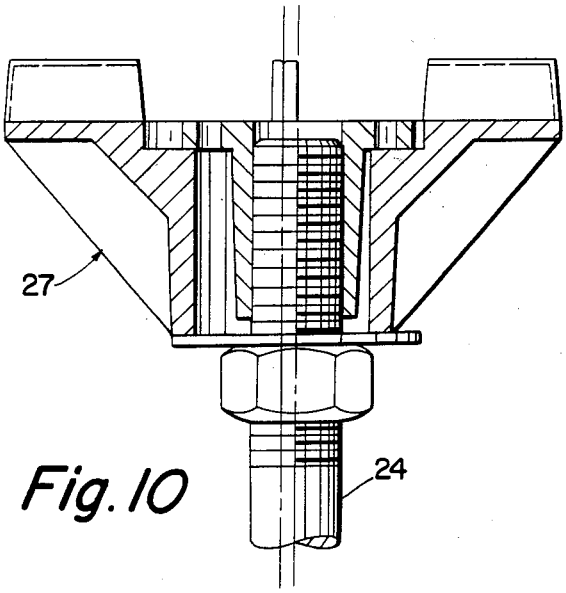
FIG. 10 is a fragmentary cross-sectional view taken along the line 10—10 of FIG. 11, illustrating lateral offsetting of a head member relative to a support rod.
Figure 11:
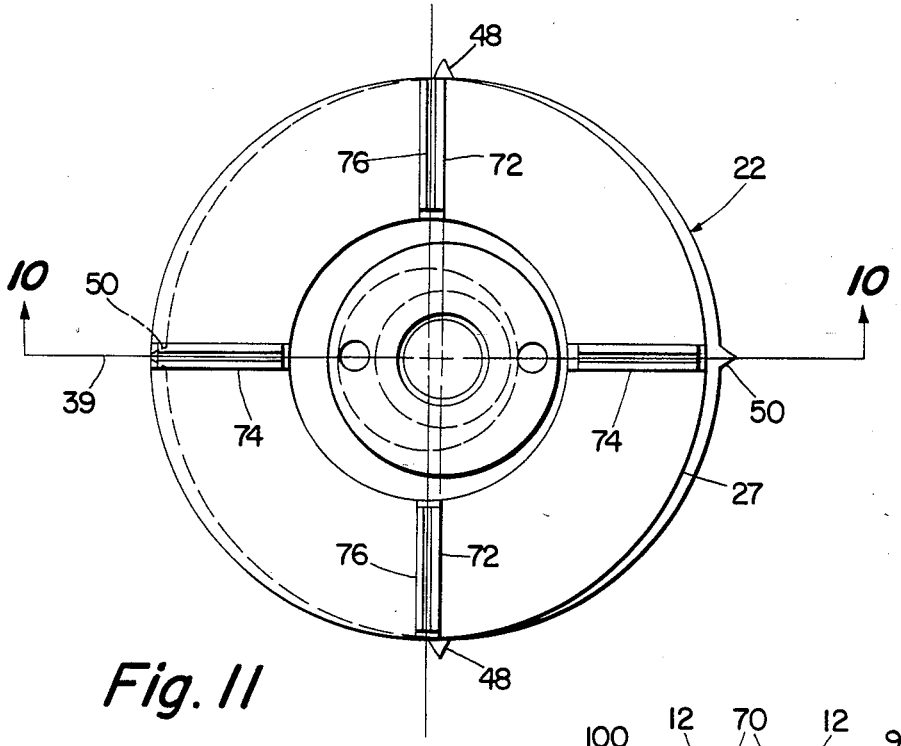
FIG. 11 is a plan view of the pedestal of FIG. 10.

It will be observed in FIG. 9 that the central bore 56 has an inner diameter 88 which is greater than the outer diameter 90 of the tubular member 78. In addition, the annular recess 64 has an inner diameter 92 which is greater than the outer diameter 94 of the radial flange 80 which is represented by the dash-dot-dot line. The inner and outer diameters 92, 94 differ by an amount which is at least equal to the difference between the inner diameter 88 of the central bore 56 and the outer diameter 90 of the tubular member 78. Because of these dimensional relationships, the head member 27—prior to tightening the clamping means 30—is rotatable about the support rod 24 and is displacable laterally in all directions relative to the support rod 24 thereby to align the lug 72, 74 with the grid lines 38, 39 and hence with the corresponding lug 72, 74 of adjacent pedestals as illustrated in FIG. 2. The rotation and laterally adjustability of the head member 27 also accommodates misalignments in the positions of the base members 22 of adjacent pedestals from the required positions. For the purpose of illustration, FIG. 11 shows an out-of-position base member 22. That is, the base member 22 has the pointed projections 50 aligned with the grid line 39 but has the pointed projections 48 displaced laterally to the right of the grid line 38. To compensate for this misalignment, the head member 27 is displaced laterally to the right to align the directional indicia (V-shaped groove 76) with the grid line 38. FIG. 10 further illustrates the lateral displacement of the head member 27 relative to the support rod 24.

Figure 15:
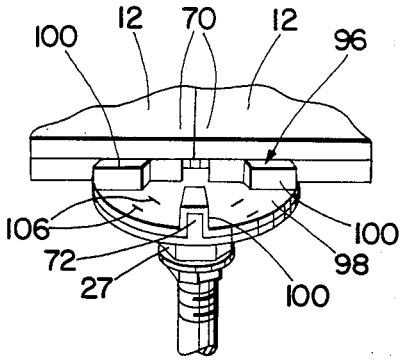
FIG. 15 is a fragmentary perspective view of a pedestal supporting two adjacent panels.
Figure 12:
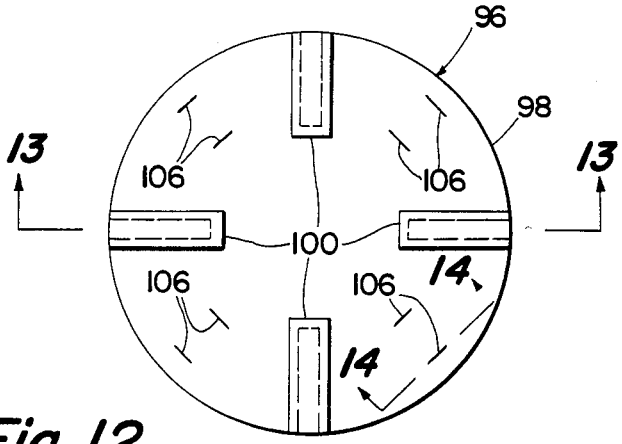
FIG. 12 is a plan view of a cushioning pad.
Figure 14:
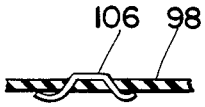
FIG. 14 is a cross-sectional view taken along the line 14—14 of FIG. 12, illustrating grounding means.
Figure 13:
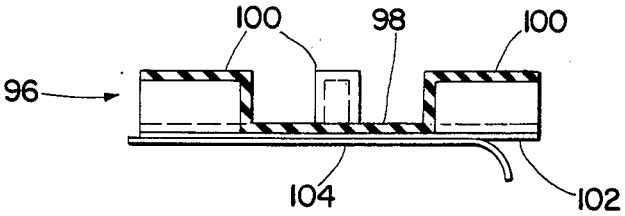
FIG. 13 is a cross-sectional view taken along the line 13—13 of FIG. 12, further illustrating the cushioning pad.

FIGS. 12 and 13 illustrate a cushioning pad 96 comprising a pad base 98 and hoods 100 which, as shown in FIG. 13, are open at the periphery of the pad base 98. When the cushioning pad 96 is installed on a head member 27, each of the hoods 100 receives one of the lugs 72 or 74, as can be seen in FIG. 15. The lower face of the pad 98 may be provided with a layer 102 of adhesive preferably of the self-adhering type, and a peel-off protective coating 104. The cushioning pad 96 may be formed from a non-conductive resilient material, such as rubber. Plural grounding staples 106 provided in each quadrant of the cushioning pad 96, may be configured as shown in FIG. 14.

We claim:

1. An adjustable pedestal adapted to support panel members of an elevated floor structure comprising:

a support rod having a threaded upper end; and a head assembly adjustably connected to said threaded upper end, said head assembly including:

a head member receiving said threaded upper end and having a generally flat upper surface which is adjustable vertically, rotationally and laterally of said threaded upper end;

abutment means adjustable along said threaded upper end and engageable by said head member, establishing a position of said head member wherein said upper surface resides in a horizontal plane; and clamping means clamping said head member to said threaded upper end.

2. The adjustable pedestal as defined in claim 1 wherein said head member includes radially extending lugs extending above said upper surface, each of said lugs being alignable with similar lugs of adjacent pedestals by rotational and lateral adjustment of said head member.

3. The adjustable pedestal as defined in claim 2 wherein each of said lugs includes directional indicium provided on an upper surface thereof to assist in aligning said lugs with similar lugs of adjacent pedestals.

4. The adjustable pedestal as defined in claim 1 wherein said head member presents an upper head end and a lower head end, and said abutment means engages one said head end and said clamping means engages the other said head end.

5. The adjustable pedestal as defined in claim 1 wherein said abutment means forms part of said clamping means.

6. The adjustable pedestal as defined in claim 1 including a base member adapted to be supported on said subfloor, said support rod extending upwardly from said base member.

7. An adjustable pedestal adapted to support panel members of an elevated floor structure comprising:

a support rod presenting a threaded upper end having an outer diameter;

a head assembly adjustably connected to said threaded upper end, said head assembly including:

a head member having an upper surface adapted to support said panel member, and a tubular portion having a central bore receiving said threaded upper end, said central bore having an inner diameter which is larger than said outer diameter of said threaded upper end, whereby said head member is movable in all directions laterally of said threaded upper end and is freely rotatable thereabout into said desired orientation;

abutment means adjustable along said threaded upper end and engageable by said head member establishing the desired height of said upper surface above said subfloor; and clamping means clamping said head member to said threaded upper end at said desired height and at said desired orientation.

8. The adjustable pedestal as defined in claim 7 wherein said abutment means forms part of said clamping means.

9. The adjustable pedestal as defined in claim 7 wherein said abutment means comprises a tubular member threaded onto said upper end and having a radial flange overlying said head member, said tubular member having an outer diameter which is less than said inner diameter of said central bore.

10. The adjustable pedestal as defined in claim 9 wherein said head member includes an annular recess in said upper surface which presents an annular shoulder engaged by said radial flange, said annular recess having an inner diameter which is greater than the outer diameter of said radial flange by an amount at least equal to the difference between the outer diameter of said tubular member and said inner diameter of said central bore.

11. The adjustable pedestal as defined in claim 10 wherein an upper surface of said radial flange and said upper surface of said head member lie in a common plane.

12. The adjustable pedestal as defined in claim 8 wherein said clamping means includes:

a nut threaded onto said upper end beneath said head member; and an annular plate supported by said nut and engaged with an annular end of said tubular portion.

13. The adjustable pedestal as defined in claim 7 including a base member adapted to be supported on said subfloor, said support rod extending upwardly from said base member.

14. An elevated floor structure comprising:

a plurality of individual pedestals supported on a generally horizontal subfloor and a plurality of panel members, said pedestals being disposed in a uniform geometric pattern over said subfloor, each of said pedestals an upstanding support rod having an upper end, and a head assembly supported by said upper end, each said head assembly comprising a head member receiving said upper end and having a generally flat upper surface which is adjustable vertically, rotationally and laterally of said upper end, abutment means adjustable along said upper end and engageable by said head member, establishing a position of said head member wherein said upper surface resides in a horizontal plane vertically spaced from said subfloor, and clamping means clamping said head member to said upper end;

each said head member including radially extending lugs extending above said upper surface, each of said lugs being aligned with a similar lug of an adjacent one of said pedestals, whereby an adajcent pair of said lugs of one pedestal cooperates with adjacent pairs of said lugs from adjacent pedestals to define a panel member supporting surface which is horizontal and coincides with said horizontal plane.

15. The elevated floor structure as defined in claim 14 wherein said head member presents an upper head end and a lower head end, said abutment means engages one said head end and said clamping means engages the other said head end.

16. The elevated floor structure as defined in claim 15 wherein said abutment means engages said upper head end.

17. The elevated floor structure as defined in claim 14 wherein said abutment means presents a generally flat reference surface used to position said abutment means along said threaded upper end.

18. The elevated floor structure as defined in claim 17 wherein said reference surface and said upper surface are coplanar.

19. The elevated floor structure of claim 14 wherein said abutment means forms part of said clamping means.

20. The elevated floor structure as defined in claim 14 wherein each of said pedestals includes a base member from which said upstanding support rod extends.

* * * * *